United States Patent [19]

Ishiguro et al.

[11] Patent Number: 4,624,034

[45] Date of Patent: Nov. 25, 1986

[54] BUCKLE APPARATUS

[75] Inventors: Kazuyoshi Ishiguro; Hidemoto Araki, both of Aichi, Japan

[73] Assignee: Kabushiki Kaisha Tokai-rika-denki-seisakusho, Aichi, Japan

[21] Appl. No.: 790,213

[22] Filed: Oct. 22, 1985

[30] Foreign Application Priority Data

Oct. 23, 1984 [JP] Japan ..... 59-160014[U]

[51] Int. Cl.[4] ..... A44B 11/25

[52] U.S. Cl. ..... 24/641; 24/636; 24/639

[58] Field of Search ..... 24/641, 642, 643, 647, 24/636, 637, 638, 639, 635, 650, 652, 655, 656

[56] References Cited

U.S. PATENT DOCUMENTS

| | | | |
|---|---|---|---|
| 3,969,795 | 7/1976 | Stephenson | 24/655 |
| 4,069,557 | 1/1978 | Loomba | 24/641 |
| 4,096,606 | 6/1978 | Stephenson | 24/641 |
| 4,228,567 | 10/1980 | Ikesue et al. | 24/642 |
| 4,310,952 | 1/1982 | Robben et al. | 24/641 |
| 4,339,854 | 7/1982 | Ikesue | 24/639 |
| 4,450,604 | 5/1984 | Oowada | 24/641 |
| 4,451,958 | 6/1984 | Robben et al. | 24/636 |
| 4,454,634 | 6/1984 | Haglund et al. | 24/641 |

FOREIGN PATENT DOCUMENTS

| | | | |
|---|---|---|---|
| 0040143 | 11/1981 | European Pat. Off. | 24/641 |
| 2073810 | 10/1981 | United Kingdom | 24/637 |

*Primary Examiner*—Victor N. Sakran

*Attorney, Agent, or Firm*—Sixbey, Friedman & Leedom

[57] ABSTRACT

A buckle apparatus for use in a seatbelt system is arranged such that when the tongue plate of the seatbelt is inserted into the buckle body, the pawl of a lock plate is inserted into an opening formed in the tongue plate. Since the projecting end of the pawl is separated from the corresponding opening formed in the buckle body, a relatively small force can release the tongue plate from the buckle apparatus. However, when the force applied to the tongue plate for pulling it out from the buckle apparatus increases, a lock plate holder is deformed by virtue of this force. In consequence, the pawl engages with the opening of the buckle body, and retaining wings provided on the side of the lock plate remote from the pawl also engage with the corresponding portions of the buckle body. Accordingly, the lock plate is supported by the buckle body at two portions on both sides of the portion thereof which engages with the tongue plate, so that the lock plate can bear a large tongue plate pulling out force.

21 Claims, 14 Drawing Figures

BUCKLE APPARATUS

BACKGROUND OF THE INVENTION

1. Field of the Invention

The present invention relates to a buckle apparatus employed in a seatbelt system designed to protect an occupant of a vehicle in an emergency situation of the vehicle.

2. Description of the Related Art

A typical conventional buckle apparatus for use in a seatbelt system is arranged such that an occupant can be fastened by an occupant restraining webbing by engaging a tongue plate attached to an end or intermediate portion of the webbing with the buckle apparatus.

There are various types of buckle apparatus. One of them is a latch type buckle apparatus in which, as shown in FIG. 13, a tongue plate 12 is engaged with a lock member 10 which has its two ends respectively supported by members 14 which constitute the apparatus body. This latch type buckle apparatus has a large tongue plate holding strength and hence extremely high engagement reliability. In this buckle apparatus, disengagement of the tongue plate 12 is effected by sliding the lock member 10 upwardly as viewed in FIG. 13.

In this type of buckle apparatus the tongue plate disengaging force, that is, the force F1 required to slide the lock member 10 when loaded, is represented by the following formula (1):

$$F1=(\mu 1+\mu 2)W\approx 2\mu W \quad (1)$$

where

W: webbing tension (load)

$\mu 1$: coefficient of friction between the lock member 10 and the members 14 $\mu 2$: coefficient of friction between the lock member 10 and the tongue plate 12

(it is assumed that $\mu 1=\mu 2=\mu$)

Accordingly, the buckle apparatus of the type described above requires a large force for disengaging the tongue plate when a large tension is acting on the webbing.

Another type of conventional buckle apparatus is a prop type buckle apparatus in which, as shown in FIG. 14, a lock member 16 is pivotally supported by a member 18 which constitutes the buckle apparatus body, and a projection 16A which projects from the lock member 16 engages with a tongue plate 12. This type of buckle apparatus requires a relatively small force F2 for disengaging the tongue plate 12 as represented by the following formula (2):

$$F2=\mu\times W=\mu\times W/\cos\theta=\mu/\cos\theta\times W$$

where if it is assumed that $\theta=16°$ $$F2\approx 1.04\mu W\approx F\tfrac{1}{2} \quad (2)$$

However, this prop type buckle apparatus has the disadvantage that the tongue plate holding strength is lower than that of the latch type buckle apparatus.

SUMMARY OF THE INVENTION

In view of the above circumstances, it is a primary object of the present invention to provide a buckle apparatus which has a large tongue plate holding strength and yet only requires a reduced force for disengaging the tongue plate.

To this end, the present invention provides a buckle apparatus in which the configuration of a lock plate which serves as a lock member and the means for retaining the lock plate are so designed that the condition in which the lock plate is supported differs depending upon whether the buckle apparatus is in a no-load or a low-load state (when the tongue plate is being disengaged), or in a high-load state (when a large tongue plate holding strength is particularly required, for example, at the time of an emergency situation of the vehicle).

More specifically, the lock plate is made of a material with a relatively high holding strength and is retained by a lock plate holder made of a material with a relatively high modulus of elasticity, the lock plate holder being pivotally supported on a buckle body.

The lock plate has a pawl which extends through an opening formed in the tongue plate so as to engage with the tongue plate. When a relatively high load acts on the lock plate through the pawl, the lock plate holder is elongated by elastic deformation, whereby two portions of the lock plate which are positioned across the tongue plate abut against and are supported by the buckle body in the vicinity of the portion which engages with the tongue plate, thereby allowing the tongue plate to be held in place by the lock plate which is supported at its two ends (in a latched fashion).

When the load is relatively low, the degree by which the lock plate holder stretches by virtue of elastic deformation is correspondingly small, so that the lock plate is not supported at its two ends as above but is pivotally supported by the buckle body through the lock plate holder alone. Therefore, only a small frictional force occurs between the lock plate and the tongue plate when the former is disengaged from the latter, which leads to the advantage that the tongue plate can be disengaged from the buckle apparatus smoothly with a reduced force.

In other words, the buckle apparatus according to the present invention resembles the prop type buckle apparatus shown in FIG. 14 when the load applied to the lock plate is relatively low and the latch type buckle apparatus shown in FIG. 13 when the load is relatively high. Thus, the present invention has the advantages of both the prop type and latch type buckle apparatuses.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and in which:

FIGS. 1 to 7 show in combination one embodiment of the buckle apparatus according to the present invention, of which:

FIG. 1 is an exploded perspective view of the whole of the buckle apparatus except for its cover;

FIG. 2 is a perspective view of the release button of the buckle apparatus, which shows the inside thereof;

FIG. 3 is a plan view of the buckle apparatus with its release button removed;

FIG. 4 is a sectional side elevational view of the buckle apparatus in engagement with the tongue plate;

FIG. 5 is a sectional side elevational view of the buckle apparatus immediately after the disengagement of the tongue plate;

FIG. 6 is a sectional side elevational view of the buckle apparatus with the tongue plate disengaged therefrom; and FIG. 7 is a sectional view of a portion of the buckle apparatus, which shows the buckle plate disengaging moment.

FIGS. 8 to 12 show in combination another embodiment of the buckle apparatus according to the present invention, of which:

FIG. 8 is an exploded perspective view of the whole of the buckle apparatus except for its cover;

FIG. 9 is a plan view of the buckle apparatus with its release button removed;

FIG. 10 is a sectional side elevational view of the buckle apparatus in engagement with the tongue plate;

FIG. 11 is a sectional side elevational view of the buckle apparatus immediately after the disengagement of the tongue plate; and FIG. 12 is a sectional side elevational view of the buckle apparatus with the tongue plate disengaged therefrom.

DESCRIPTION OF THE PREFERRED EMBODIMENTS

FIGS. 1 to 7 show in combination one embodiment of the buckle apparatus according to the present invention.

Figure 1:
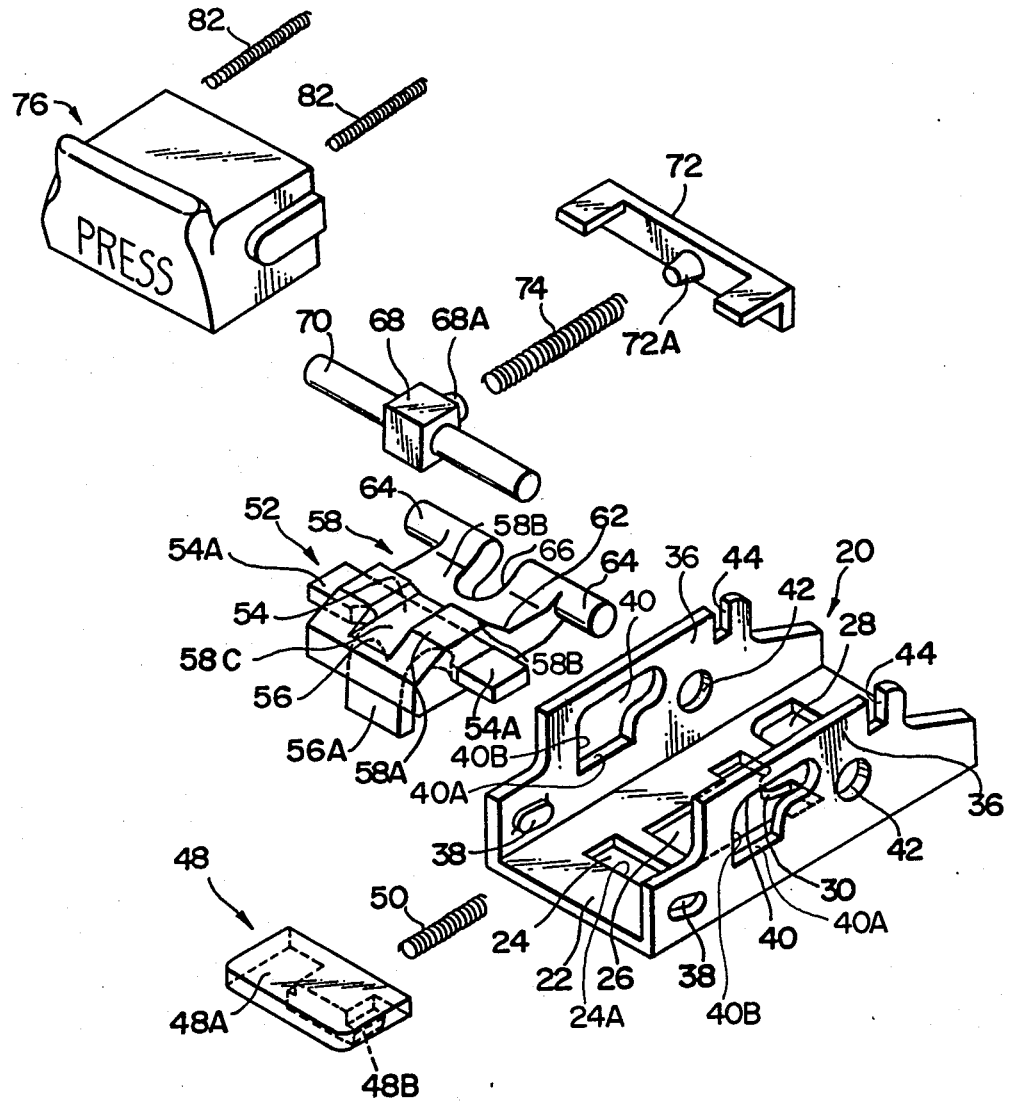
Figure 3:
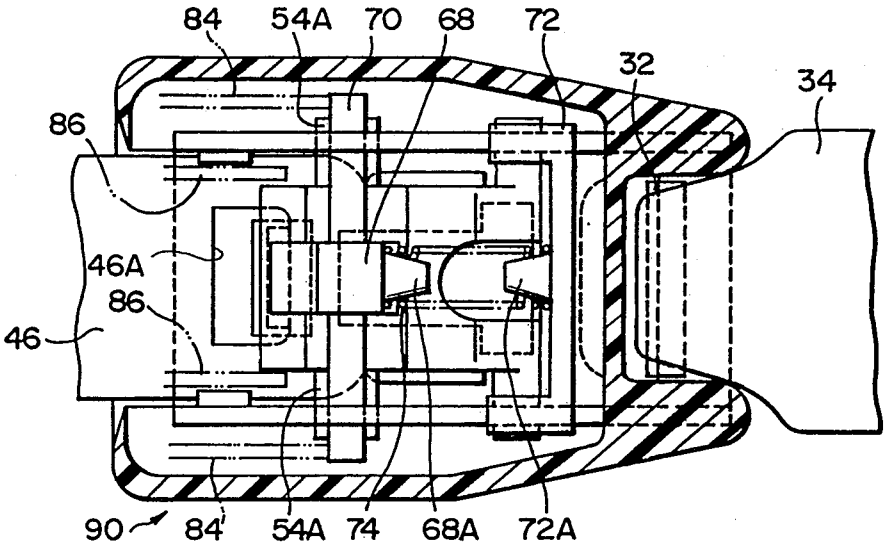
Figure 4:
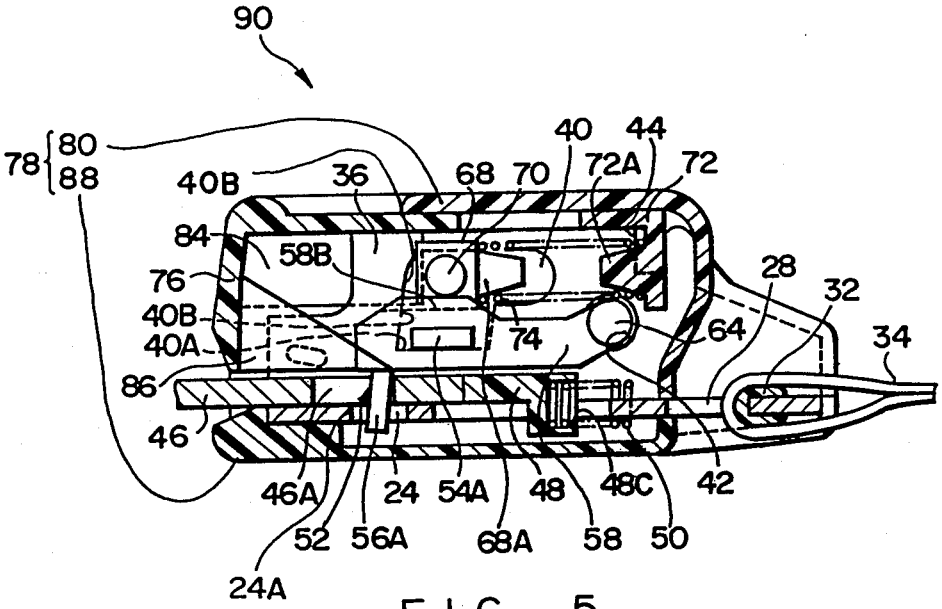

Referring first to FIG. 1, a buckle body 20 is formed from steel plate with a predetermined strength which is bent such as to have a U-shaped cross-section. The buckle body 20 has a base portion 22 formed with openings 24, 26 and 28 in that order, from the front end toward the rear end. The openings 24 and 28 are rectangular, while the opening 26 has a substantially T-shaped configuration. The center of the rear edge of the opening 26 remains uncut so as to provide a projection 30. As shown in FIGS. 3 and 4, one end of a strap 34 is engaged with the opening 28 through a protector 32. The other end of the strap 34 is secured to the vehicle body through an anchor plate or the like.

Parallel leg plate portions 36 and 36 project from both lateral ends of the base portion 22. Each of the leg plate portions 36 and 36 is formed with a projection 38, a substantially L-shaped opening 40, a circular opening 42 and a notch 44 in that order, from the front end toward the rear end. The projections 38 and 38 inwardly project from the respective leg plate portions 36 and 36 so as to position a tongue plate 46 (see FIGS. 3 and 4) in place by limiting the upward movement of the tongue plate 46 from the buckle body 20.

As shown in FIG. 1, an ejector 48 is constituted by a flat rectangular parallelepiped body portion 48A and a guide portion 48B which is integrally formed with the body portion 48A such as to project from the lower side thereof. As shown in FIG. 4, a recess 48C which serves as a spring retaining seat is formed in the rear surface of the ejector 48. The ejector 48 is mounted on the buckle body 20 in such a manner that the guide portion 48B is fitted into the central opening 26 formed in the base portion 22 of the buckle body 20, and a compression coil spring 50 is disposed between the recess 48C of the ejector 48 and the projection 30 extending into the opening 26. Thus, the ejector 48 is biased by means of the compression coil spring 50 so as to move leftwardly as viewed in FIG. 4.

A lock plate 52 is, as shown in FIG. 1, formed from a substantially T-shaped steel plate in such a manner that its leg portion 56 which projects from its horizontal portion 54 is bent at approximately right angles at the joint thereof. The lock plate 52 is integrally formed with a lock plate holder 58 of a synthetic resin by means of insert molding. The lock plate 52 partially projects from the lock plate holder 58. The projecting portion of the leg portion 56 serves as a pawl 56A which engages with the tongue plate 46, while the projecting portions of the horizontal portion 54 serve as retaining wings 54A and 54A.

The lock plate holder 58 has a stepped upper surface which is constituted by upper and lower steps 58A, 58B and a slanting push-down guide surface 62 defined by the boundary area between the steps 58A and 58B. The upper step 58A is formed with a notched groove 58C. Shafts 64 and 64 respectively project from both lateral ends of the rearmost portion of the lock plate holder 58. In addition, a notch 66 is formed in the center of the rear portion of the lock plate holder 58.

The lock plate 52 integrated with the lock plate holder 58 is mounted on the buckle body 20 in such a manner that the retaining wings 54A and 54A are respectively fitted into the substantially L-shaped openings 40 and 40 formed in the leg plate portions 36 and 36 of the buckle body 20, as shown in FIGS. 3 and 4. Then, the lock plate holder 58 is pivotally supported on the buckle body 20 in such a manner that the shafts 64 and 64 are respectively fitted into the circular openings 42 and 42 formed in the leg plate portions 36 and 36. During this fitting, since the lock plate holder 58 is formed with the notch 66, the shafts 64 and 64 are deflected to a large extent toward the center of the lock plate holder 58, thereby allowing the shafts 64 and 64 to be easily fitted into the circular openings 42 and 42.

As shown in FIG. 1, a substantially cubic lock piece 68 of a synthetic resin is integrally formed with a lock pin 70 constituted by a steel bar by means of insert molding in such a manner that the lock piece 68 is located in the center of the lock pin 70. The lock piece 68 is formed with a frustoconical projection 68A. The lock piece 68 integrated with the lock pin 70 is mounted on the buckle body 20 in such a manner that both end portions of the lock pin 70 are rotatably fitted into the respective substantially L-shaped openings 40 and 40 formed in the leg plate portions 36 and 36 of the buckle body 20, as shown in FIGS. 3 and 4.

A spring holder 72 is, as shown in FIG. 1, constituted by an L-shaped plate member which is notched at the central portion of one side thereof and which is formed with a frustoconical projection 72A projecting from the center of the other side thereof. The spring holder 72 is fitted into the notches 44 and 44 formed in the leg plate portions 36 and 36 of the buckle body 20 so as to be supported thereby, as shown in FIGS. 3 and 4. A compression coil spring 74 is disposed between the projection 72A of the spring holder 72 and the projection 68A of the lock piece 68, thus biasing the lock piece 68 toward the left as viewed in FIG. 4.

Figure 2:
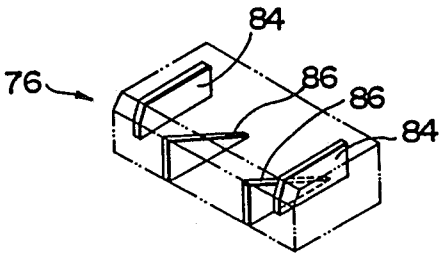

A release button 76 is slidably disposed on an upper cover member 80 which constitutes, together with a lower cover member 88, a buckle cover 78 (see FIG. 4), and is biased toward the left as viewed in FIG. 4 by means of compression coil springs 82 and 82 disposed between the release button 76 and the upper cover member 80. It is to be noted that the compression coil springs 82 and 82 are not shown in FIGS. 3 to 6. As shown in FIG. 2, the release button 76 is formed therein with lock pin pressing walls 84 and 84, and slanting guide walls 86 and 86 which upwardly guide the respective retaining wings 54A and 54A of the lock plate 52.

When the buckle body 20 which has the above-described elements housed therein is incorporated in the upper cover member 80 having the release button 76 disposed therein, the lock pin pressing walls 84 and 84 respectively face both end portions of the lock pin 70 on the outside of the buckle body 20, and the slanting guide walls 86 and 86 respectively face the lower sides of the retaining wings 54A and 54A of the lock plate 52 on the inside of the buckle body 20. It is to be noted that the release button 76 is not shown in FIG. 3.

The lower cover member 88 (see FIG. 4) is fitted to the upper cover member 80 assembled as above, thus completing the assembly of the buckle apparatus 90.

The above-described tongue plate 46 has a rectangular opening 46A at its leading end portion, and one end of a webbing (not shown) is attached to the trailing end portion of the tongue plate 46. The other end of the webbing is secured to the vehicle body through an anchor plate or the like.

The following is a description of the operation of this embodiment.

Figure 6:
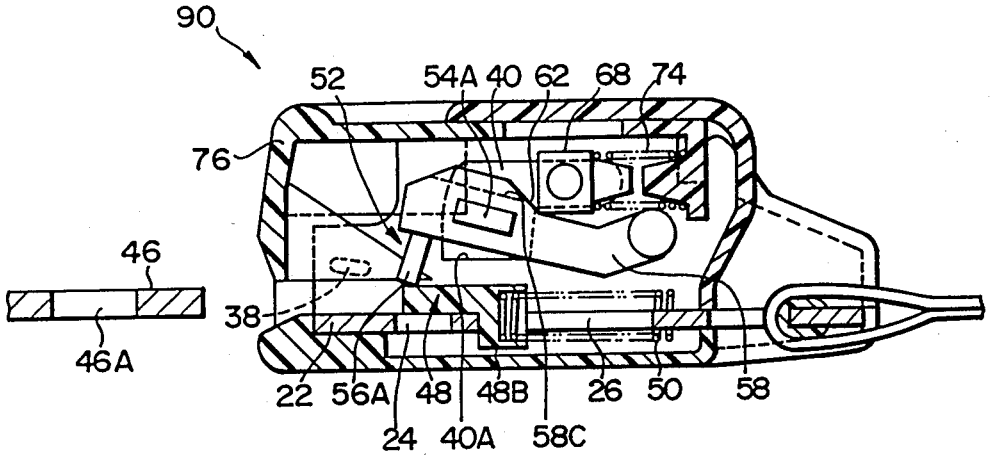
Figure 7:
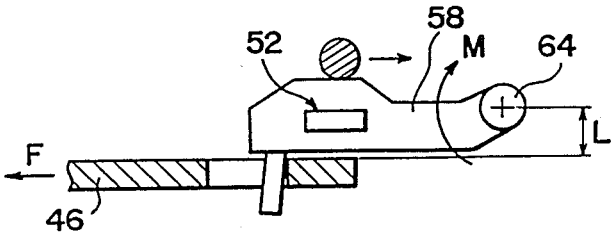

FIG. 6 shows the buckle apparatus 90 before the tongue plate 46 is inserted thereinto. Under this state, the ejector 48 which is biased by means of the compression coil spring 50 is positioned at the extremity of its advancement, and the guide portion 48B abuts against the end face of the opening 26 formed in the base portion 22 of the buckle body 20. The pawl 56A of the lock plate 52 abuts against the upper surface of the ejector 48.

Since the lock plate holder 58 is pressed downwardly by the lock piece 68 which is biased by the compression coil spring 74, the lock plate 52 is subjected to this force which causes it to pivot counterclockwise. Accordingly, the pawl 56A of the lock plate 52 presses against the upper surface of the ejector 48. It is to be noted that the lock piece 68 abuts and presses against the lower end portion of the slanting push-down guide surface 62 of the lock plate holder 58. The release button 76 which is biased leftwardly by means of the compression coil springs 82 and 82 is positioned at the extremity of its advancement.

Under this set of conditions, the tongue plate 46 is inserted into the area defined between the base portion 22 and the projections 38, 38 of the buckle apparatus 90 from the left as viewed in FIG. 6. On being inserted, the leading end of the tongue plate 46 presses the ejector 48 rightwardly. As the ejector 48 is moved rightwardly against the biasing force of the compression coil spring 50, the leading end of the tongue plate 46 is positioned below the distal end of the pawl 56A of the lock plate 52. As the tongue plate 46 is pushed further rightwardly, the distal end of the pawl 56A of the lock plate 52 is positioned above the opening 46A of the tongue plate 46.

When the pawl 56A is positioned above the opening 46A, the lock plate holder 58 is allowed to pivot counterclockwise through the push-down guide surface 62 which is pressed by the lock piece 68 which is biased by the compression coil spring 74. In consequence, the pawl 56A instantaneously enters the opening 46A of the tongue plate 46, and the distal end of the pawl 56A further moves through the opening 46A and enters the opening 24 formed in the base portion 22 of the buckle body 20 so as to extend therethrough. The lock plate 52 pivots until the reverse surfaces of the retaining wings 54A and 54A respectively abut against the bottom surfaces 40A and 40A of the substantially L-shaped openings 40 and 40 formed in the leg plate portions 36 and 36 of the buckle body 20.

The above-described pivotal operation of the lock plate 52 takes place while the lock piece 68 linearly moves leftwardly from the push-down guide surface 62 of the lock plate holder 58 along the notched groove 58C. It is to be noted that the lock piece 68 which has reached the upper end of the push-down guide surface 62 enters the notched groove 58C of the lock plate holder 58 and further moves leftwardly while slidably contacting the groove 58C until it abuts and presses against the lock pin pressing walls 84 and 84 of the release button 76.

This state is shown in FIGS. 3 and 4. In this state, the tongue plate 46 is pressed by the ejector 48 which is biased by the compression coil spring 50, and there is therefore no risk of any play or chattering occurring between the tongue plate 46 and the lock plate 52. Since the lock piece 68 is positioned in the notched groove 58C of the lock plate holder 58, the lock plate holder 58 is prevented from pivoting clockwise. Accordingly, there is no risk of the tongue plate 46 being accidentally disengaged.

When a relatively large tension acts on the webbing in a state wherein the buckle apparatus 90 and the tongue plate 46 are in engagement with each other as described above, the tension further acts on the pawl 56A of the lock plate 52 through the tongue plate 46. The lock plate 52 is made from steel plate and has a lower modulus of elasticity than that of the lock plate holder 58 made of a synthetic resin. Accordingly, the lock plate holder 58 is first elongated by elastic deformation by virtue of the tension of the webbing. This stretching of the lock plate holder 58 causes the pawl 56A of the lock plate 52 to abut against the front end face 24A of the opening 24 formed in the base portion 22 of the buckle body 20 and also causes the retaining wings 54A and 54A to abut against the respective front end faces 40B and 40B of the substantially L-shaped opening 40 and 40 formed in the leg plate portions 36 and 36 of the buckle body 20.

After the pawl 56A and the retaining wings 54A and 54A have thus come into abutment with the buckle body 20, the tongue plate 46 is engaged with and supported by the intermediate portion of the lock plate 52 which has its two ends supported by the buckle body 20, as described above. As the webbing tension decreases, the lock plate holder 58 contracts in the direction of returning to its original shape, so that the lock plate 52 is supported at only one end thereof through the lock plate holder 58.

To disengage the tongue plate 46 from the buckle apparatus 90, the release button 76 which is in the state shown in FIGS. 3 and 4 is moved rightwardly against the biasing forces of the compression coil springs 82 and 82. As the release button 76 is moved rightwardly, the lock pin 70 is first rightwardly moved by the pressure from the lock pin pressing walls 84 and 84 formed inside the release button 76. The movement of the lock pin 70 causes the lock piece 68 integrated therewith to move rightwardly against the biasing force of the compression coil spring 74.

At the same time as the lock piece 68 passes through the notched groove 58C of the lock plate holder 58, the slanting guide walls 86 and 86 formed inside the release button 76 come into contact with the retaining wings 54A and 54A of the lock plate 52. As the release button 76 is moved further rightwardly in this state, the lock pin 70 and the lock piece 68 are pressed by the lock pin pressing walls 84 and 84 such as to themselves move further rightwardly, thus causing the retaining wings 54A and 54A to be gradually moved upwardly by means of the slanting guide walls 86 and 86. In consequence, the lock plate 52 (and the lock plate holder 58) is pivoted clockwise.

It is to be noted that the shafts 64 (the center of pivotal motion) which support the lock plate 52 and the lock plate holder 58 are located at a higher position than that of the tongue plate 46 when engaged with the lock plate 52 (the distance therebetween is represented by L). For this reason, when the tongue plate 46 is subjected to a force F which acts thereon such as to pull out the tongue plate 46 from the buckle apparatus 90, clockwise disengaging moment M ($=F\times L$) acts on both the lock plate 52 and the lock plate holder 58. Therefore, it is normally possible to disengage the engagement portions from each other without the aid of the slanting guide walls 86 and 86.

At the same time as the distal end of the pawl 56A is disengaged from the opening 46A of the tongue plate 46 in response to the pivoting of the lock plate 52, the ejector 48 which is biased by means of the compression coil spring 50 instantaneously moves leftwardly, thus causing the tongue plate 46 to be ejected out of the buckle apparatus 90. When the ejector 48 has ejected the tongue plate 46, the ejector 48 is positioned below the distal end of the pawl 56A of the lock plate 52. This state is shown in FIG. 5.

Figure 5:
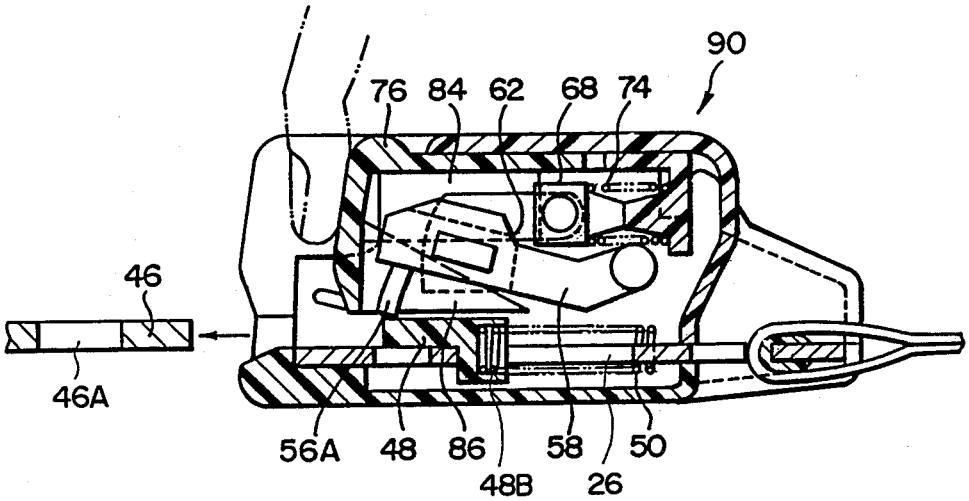

When the release button 76 in the state shown in FIG. 5 is released, the release button 76 is moved leftwardly by means of the biasing forces of the compression coil springs 82 and 82. At the same time, the lock piece 68 is also moved leftwardly by means of the biasing force of the compression coil spring 74 until it abuts and presses against the lower end portion of the slanting push-down guide surface 62 of the lock plate holder 58. This state is the one which is shown in FIG. 6 which shows the buckle apparatus 90 before the insertion of the tongue plate 46.

As described above, in this embodiment, the lock plate 52 made from steel plate is integrated with the lock plate holder 58 of a synthetic resin which is pivotally supported on the buckle body 20. Under a high load, the lock plate holder 58 is elastically deformed to a large extent, causing the pawl 56A and the retaining wings 54A and 54A formed on the lock plate 52 to abut against the corresponding portions of the buckle body 20 so as to be supported thereby. Thus, the lock plate 52 is supported at its two ends with the tongue plate 46 held by the portion therebetween. Accordingly, under a high load the lock plate 52, which has a large tongue plate holding strength, supports the tongue plate 46 in a latch fashion, so that the buckle apparatus 90 has an extremely high engagement strength.

Under a low load, the degree by which the lock plate holder 58 is elastically deformed is so small that the lock plate 52 does not abut against any portion of the buckle body 20 in the direction in which the tongue plate 46 is pulled up. In consequence, the above-described abutment support does not take place, and the tongue plate 46 is held by the lock plate 52 which is supported at only one end thereof. Accordingly, under a low load, only a relatively small force is required to disengage the tongue plate 46 from the buckle apparatus 90, since a relatively small frictional force occurs between the lock plate 52 and the tongue plate 46.

FIGS. 8 to 12 show in combination another embodiment of the buckle apparatus according to the present invention.

Figure 8:
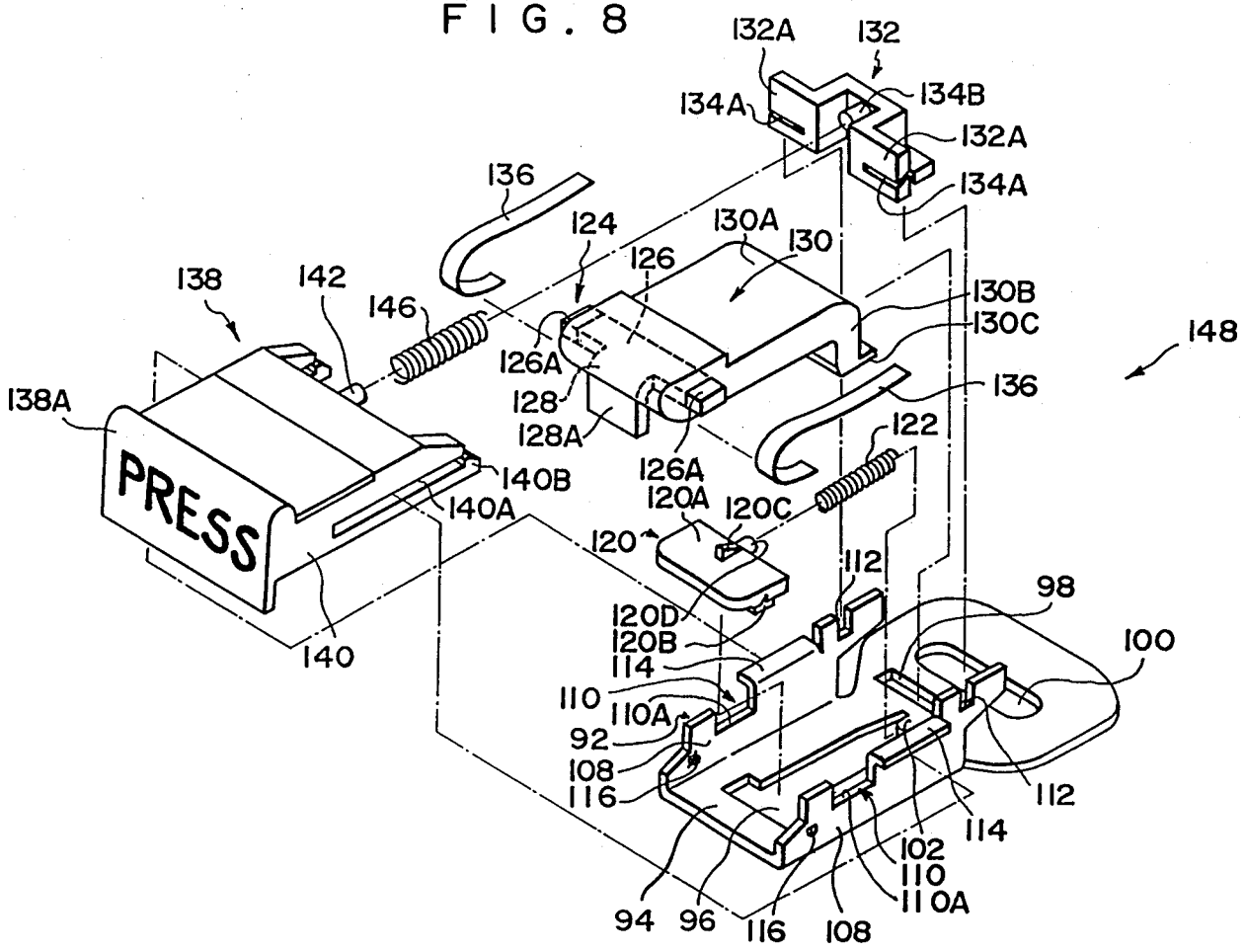
Figure 9:
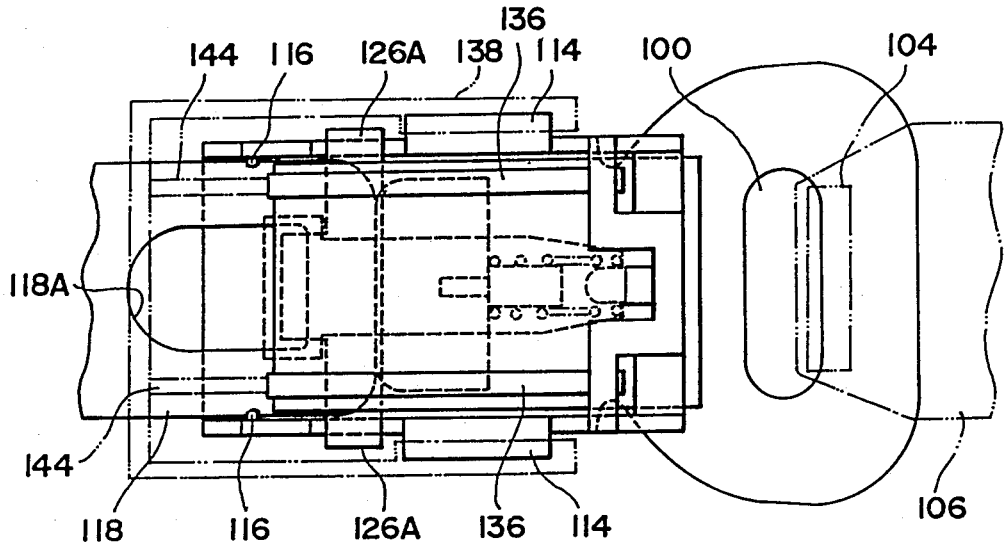
Figure 10:
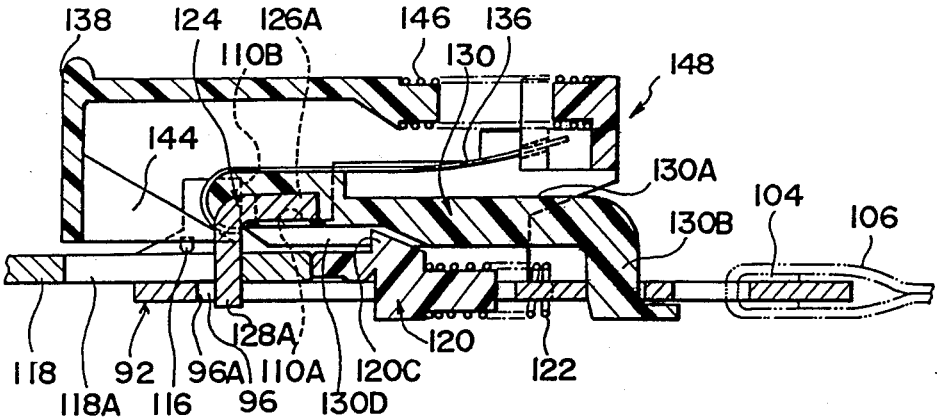

Referring first to FIG. 8, a buckle body 92 is formed from steel plate with a predetermined strength which is partially bent such as to have a U-shaped cross-section. The buckle body 92 has a base portion 94 formed with openings 96, 98 and 100 in that order, from the front end toward the rear end. The openings 98 and 100 are rectangular, while the opening 96 has a substantially T-shaped configuration. The center of the rear edge of the opening 96 remains uncut so as to provide a projection 102. As shown in FIGS. 9 and 10, one end of a strap 106 is engaged with the opening 100 through a protector 104. The other end of the strap 106 is secured to the vehicle body through an anchor plate or the like.

Parallel leg plate portions 108 and 108 project from both lateral ends of the base portion 94. Each of the leg plate portions 108 and 108 is formed with rectangular notches 110 and 112 at its front and rear end portions, respectively. Guide flanges 114 and 114 are formed at the respective centers of the leg plate portions 108 and 108 and extend outwardly therefrom. Projections 116 and 116 are formed at the respective front end portions of the leg plate portions 108 and 108 so as to project inwardly thereof. The projections 116 and 116 limit the upward movement of a tongue plate 118 (see FIGS. 9 and 10) from the buckle body 92, thereby allowing the tongue plate 118 to be held fast in the vertical direction.

As shown in FIG. 8, an ejector 120 is constituted by a flat rectangular parallelepiped body portion 120A, a guide portion 120B and a stopper portion 120C, which are integrally formed together, the guide portion 120B projecting from the lower side of the body portion 120A, and the stopper portion 120C projecting from the upper side of the body portion 120A. Further, a projection 120D which serves as a spring guide is formed on the rear face of the ejector 120. The ejector 120 is mounted on the buckle body 92 in such a manner that the guide portion 120B is fitted into the opening 96 formed in the base portion 94 of the buckle body 92, thereby allowing the ejector 120 to move in the longitudinal direction of the buckle body 92. A compression coil spring 122 is disposed between the projection 120D of the ejector 120 and the projection 102 extending into the opening 96. The ejector 120 is biased by means of the compression coil spring 122 so as to move leftwardly as viewed in FIG. 10.

A lock plate 124 is, as shown in FIG. 8, formed from a substantially T-shaped steel plate in such a manner that its leg portion 128 which projects from a horizontal portion 126 is bent at approximately right angles at the joint thereof. The lock plate 124 is integrally formed with a lock plate holder 130 of a synthentic resin by means of insert molding. The lock plate 124 partially projects from the lock plate holder 130. The projecting portion of the leg portion 128 serves as a pawl 128A which engages with the tongue plate 118, while the projecting portions of the horizontal portion 126 serve as retaining wings 126A and 126A.

The lock plate holder 130 is bent such as to have a step-like shape. The lock plate holder 130 is constituted by a body portion 130A which is integrated with the lock plate 124, a leg portion 130B and a retaining portion 130C. As shown in FIG. 10, a groove 130D is formed in the center of the reverse surface of the body portion 130A such as to extend in the longitudinal direction of the body portion 130A. The stopper portion 120C of the ejector 120 is to be positioned in the groove 130D.

The lock plate holder 130 is mounted on the buckle body 92 in such a manner that the end portion of the retaining portion 130C is first inserted into the opening 98 formed in the base portion 94 of the buckle body 92, and the leg portion 130B is then retained by the peripheral edge of the opening 98. Thus, the lock plate holder 130 is pivotal about the leg portion 130B retained by the peripheral edge of the opening 98, and the retaining wings 126A and 126A of the lock plate 124 are able to abut against the respective bottoms 110A and 110A of the notches 110 and 110 formed in the leg plate portions 108 and 108 of the buckle body 92.

A spring holder 132 has both end portions 132A and 132A respectively formed with slits 134A and 134A for retaining corresponding springs. A projection 134B which serves as a spring guide is formed in the recess in the center of the spring holder 132. The spring holder 132 is mounted on the buckle body 92 in such a manner that the end portions 132A and 132A are respectively fitted into and retained by the notches 112 and 112 formed in the leg plate portions 108 and 108 of the buckle body 92. During this fitting, the bent portion at the distal end of each of the J-shaped leaf springs 136 and 136 is tightly fitted on the body portion 130A of the lock plate holder 130 so as to be retained thereby, while the rear end portion of each leaf spring 136 is inserted into one of the slits 134A and 134A of the spring holder 132 so as to be retained thereby. Thus, the lock plate holder 130, integrated with the lock plate 124, is biased by means of the leaf springs 136 and 136 so as to pivot counterclockwise as viewed in FIG. 10.

A release button 138 has side plate portions 140 and 140 at both lateral ends thereof. A projection 142 which serves as a spring guide is formed in the center of the rear end of the release button 138. Each of the side plate portions 140 and 140 is formed with a notch 140A which extends from the rear end toward the front end. A hooked retaining portion 140B is formed at the rear end of the lower portion of each of the side plate portions 140 and 140 which are split into upper and lower portions by the corresponding notches 140A and 140A. As shown in FIGS. 9 and 10, wedge-shaped slanting guide walls 144 and 114 project from the inner wall of the operating portion 138A of the release button 138 so as to be disposed within the area defined between the side plate portions 140 and 140.

The release button 138 is mounted on the buckle body 92 in such a manner that the side plate portions 140 and 140 are disposed on the respective outsides of the leg plate portions 108 and 108 of the buckle body 92, and the notches 140A and 140A respectively receive the guide flanges 114 and 114, thereby allowing the release button 138 to move in the longitudinal direction of the buckle body 92. A compression coil spring 146 is disposed between the projection 142 formed on the release button 138 and the projection 134B formed on the spring holder 132. The release button 138 is biased by means of the compression coil spring 146 so as to move leftwardly as viewed in FIG. 10. It is to be noted that when the retaining portions 140B and 140B engage with the respective rear ends of the guide flanges 114 and 114, the release button 138 is prevented from further moving leftwardly.

A cover which is constituted by upper and lower cover members (not shown) is mounted on the buckle body 92 having the various elements incorporated therein as described above, thus completing the assembly of the buckle apparatus 148.

The above-described tongue plate 118 has a rectangular opening 118A at its leading end portion, and one end of a webbing (not shown) is attached to the trailing end portion of the tongue plate 118. The other end of the webbing is secured to the vehicle body through an anchor plate or the like.

The following is a description of the operation of the above-described embodiment.

Figure 12:
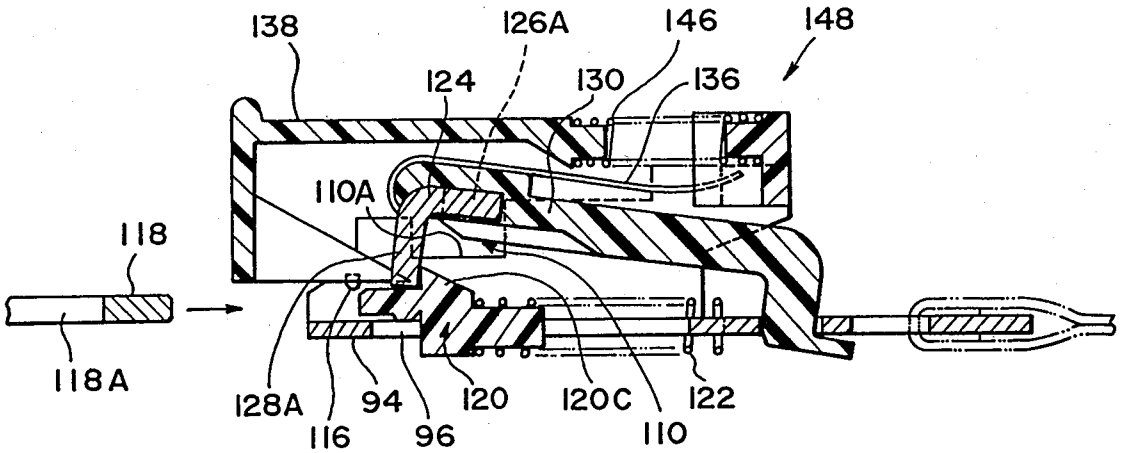
Figure 14:
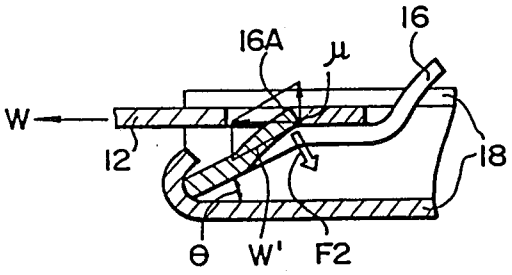
FIGS. 13 and 14 are sectional views which show the respective principles of two types of conventional buckle apparatus.
Figure 13:
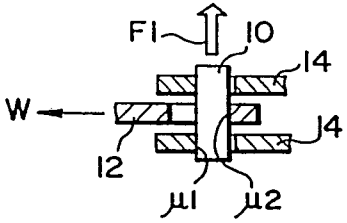

FIG. 12 shows the buckle apparatus 148 before the insertion of the tongue plate 118. In this state, the ejector 120 which is biased by means of the compression coil spring 112 is positioned at the extremity of its advancement, and the stopper portion 120C abuts against the reverse surface of the pawl 128A of the lock plate 124. The upper surface of the ejector 120 is contacted by the distal end of the pawl 128A of the lock plate 124.

Since the lock plate holder 130 is biased by means of the leaf springs 136 and 136, the lock plate 124 is subjected to force which causes it to pivot counterclockwise. Accordingly, the pawl 128A of the lock plate 124 abuts and presses against the upper surface of the ejector 120. The release button 138 which is biased leftwardly by means of the compression coil spring 146 is positioned at the extremity of its advancement.

Under this state, when the tongue plate 118 is inserted into the area defined between the base portion 94 and the projections 116, 116 of the buckle apparatus 148 from the left as viewed in FIG. 12, the leading end of the tongue plate 118 presses the ejector 120 rightwardly as viewed in FIG. 12. When the ejector 120 is moved rightwardly against the biasing force of the compression coil spring 122, the leading end of the tongue plate 118 is positioned below the distal end of the pawl 128A of the lock plate 124. When the tongue plate 118 is pushed further rightwardly, the distal end of the pawl 128A of the lock plate 124 is positioned above the opening 118A of the tongue plate 118.

When the pawl 128A is positioned above the opening 118A, the lock plate holder 130 is allowed to pivot counterclockwise by means of the biasing forces of the leaf springs 136 and 136. In consequence, the pawl 128A instantaneously enters the opening 118A of the tongue plate 118, and the distal end of the pawl 128A further moves through the opening 118A and enters the opening 96 formed in the base portion 94 of the buckle body 92 so as to extend therethrough. The lock plate 124 pivots until the reverse surfaces of the retaining wings 126A and 126A abut against the bottom surfaces 110A and 110A of the notches 110 and 110 formed in the leg plate portions 108 and 108 of the buckle body 92.

This state is shown in FIGS. 9 and 10, in which the tongue plate 118 is pressed by the ejector 120 which is biased by means of the compression coil spring 122. There is therefore no risk of any play or chattering occurring between the tongue plate 118 and the lock plate 124.

When a large tension acts on the webbing in a state wherein the buckle apparatus 148 and the tongue plate 118 are in engagement with each other as described above, the tension further acts on the pawl 128A of the lock plate 124 through the tongue plate 118. The lock plate 124 is made from steel plate and has a lower modulus of elasticity than that of the lock plate holder 130 made of a synthetic resin. Accordingly, the lock plate holder 130 is first elongated by elastic deformation by virtue of the tension of the webbing, mainly at the joint between the body portion 130A and the leg portion 130B. This elongation of the lock plate holder 130 causes the pawl 128A of the lock plate 124 to abut against the front end face 96A of the opening 96 formed in the base portion 94 of the buckle body 92 and also causes the retaining wings 126A and 126A to abut against the respective front end faces 110B and 110B of the notches 110 and 110 formed in the leg plate portions 108 and 108 of the buckle body 92.

After the pawl 128A and the retaining wings 126A and 126A have thus come into abutment with the buckle body 92, the tongue plate 118 is engaged with and supported by the intermediate portion of the lock plate 124 which has its two ends supported by the buckle body 92, as described above. As the webbing tension decreases, the lock plate holder 130 contracts in the direction of returning to its original shape, so that the lock plate 124 is supported at only one end thereof through the lock plate holder 130.

To disengage the tongue plate 118 from the buckle apparatus 148, the release button 138 which is in the state shown in FIGS. 9 and 10 is moved rightwardly against the biasing force of the compression coil spring 146. As the release button 138 is moved rightwardly, the slanting guide walls 144 and 144 formed inside the release button 138 come in contact with the lock plate holder 130. It is to be noted that the slanting guide walls 144 and 114 come in contact with the lock plate holder 130 indirectly, through the leaf springs 136 and 136 attached to the holder 130 so as to be retained thereby. As the release button 138 is moved further rightwardly in this state, the lock plate holder 130 is guided by the slanting guide walls 144 and 114 in such a manner that the distal end portion of holder 130 is gradually moved upwardly. In consequence, the lock plate 124 (and the lock plate holder 130) is pivoted clockwise.

At the same time as the distal end of the pawl 128A is disengaged from the opening 118A of the tongue plate 118 in response to the pivoting of the lock plate 124, the ejector 120 which is biased by means of the compression coil spring 122 instantaneously moves leftwardly, thus causing the tongue plate 118 to be ejected out of the buckle apparatus 148. When the ejector 120 has ejected the tongue plate 118, the stopper portion 120C abuts against the reverse surface of the pawl 128A of the lock plate 124, and the lock plate 124 ceases pivoting. This state is shown in FIG. 11.

Figure 11:
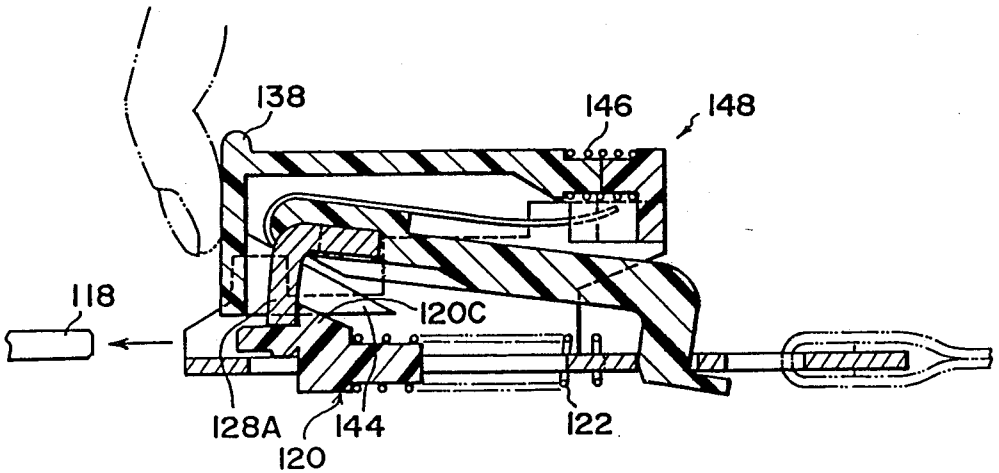

When the release button 138 in the state shown in FIG. 11 is released, the release button 138 is moved leftwardly by means of the biasing force of the compression coil spring 146. This state is the one which is shown in FIG. 12 which shows the buckle apparatus 148 before the insertion of the tongue plate 118.

As described above, in this embodiment, the lock plate 124 made from steel plate is integrated with the lock plate holder 130 made of a synthetic resin which is pivotally supported on the buckle body 92 in a manner similar to that in the first embodiment. Accordingly, under a high load, the lock plate 124 displays an extremely high tongue plate holding strength, while only a reduced force is required for disengaging the tongue plate 118.

Further, in this embodiment, the leg portion 130B of the lock plate holder 130 is supported by the base portion 94 of the buckle body 92. For this reason, when the tongue plate 118 is subjected to a force which acts thereon such as to pull out the tongue plate 118 from the buckle apparatus 148, counterclockwise disengaging moment (as viewed in FIG. 10) acts on both the lock plate 124 and the lock plate holder 130 in the reverse direction to that in the first embodiment which is described in relation to FIG. 7. There is therefore no risk of the lock plate 124 being undesirably disengaged by that pulling-out force which is applied to the tongue plate 118.

As has been described above, the buckle apparatus according to the present invention is arranged such that the lock plate with a relatively high holding strength is retained by the lock plate holder with a relatively high modulus of elasticity, the lock plate holder being pivotally supported on the buckle body. When a relatively high load acts on the lock plate, the lock plate holder is elongated by elastic deformation, whereby two portions of the lock plate across the tongue plate abut against and are supported by the buckle body in the vicinity of the portion which engages with the tongue plate, thereby allowing the tongue plate to be held in place by the lock plate which is supported at its two ends. When the load is relatively low, the lock plate is not supported at its two ends as described above but is pivotally supported by the buckle body through the lock plate holder alone. Accordingly, the buckle apparatus according to the present invention has a large tongue plate holding strength under a high load, and yet only requires a reduced force for disengaging the tongue plate.

What is claimed is:

1. A buckle apparatus employed in a seatbelt system designed to protect an occupant of a vehicle in an emergency situation of the vehicle, said apparatus being used for engagement with a tongue plate connected to an occupant restraining webbing when the occupant fastens said webbing, and said apparatus comprising:

(a) a buckle body mounted on the vehicle body for receiving said tongue plate;

(b) a lock plate inserted into an opening formed in said tongue plate when inserted into said buckle body in such a manner that the distal end of said lock plate projects out to the other side of said tongue plate, said lock plate being supported by said buckle body at portions on both sides of the portion which is received in said opening; and (c) regulating means which allows at least one of said pair of support portions of said lock plate which support it on said buckle body to be separated from said buckle body when the force applied to said tongue plate such as to pull out said tongue plate from said buckle apparatus is relatively small, but which is formed of a flexible material which engages with said buckle body by elastic deformation when said force is relatively large, whereby when the vehicle is in a normal state, it is possible to disengage said lock plate from said tongue plate with a relatively small force, and when the vehicle runs into an emergency situation, said lock plate is supported by said buckle body at both sides of the portion of said lock plate which abuts against the edge of said opening of said tongue plate, thus resisting any relatively large force acting on said tongue plate in such a manner that said tongue plate would be undesirably pulled out of said buckle apparatus without said support of said lock plate.

2. A buckle apparatus according to claim 1, wherein said regulating means is a member of a synthetic resin which is interposed between said lock plate and said buckle body.

3. A buckle apparatus according to claim 1, wherein said lock plate has a pair of retaining wings which project in opposite directions from each other, said retaining wings respectively facing two portions on one side of said buckle body so as to constitute in combination one of said pair of support portions.

4. A buckle apparatus according to claim 3, wherein said lock plate has a projecting pawl which extends through said opening of said tongue plate in such a manner that the distal end of said pawl faces a portion on the other side of said buckle body, thereby constituting the other of said pair of support portions 5. A buckle apparatus according to claim 3, wherein each of said pair of retaining wings faces the opening corresponding thereto formed in a pair of leg plates projecting upwardly from said buckle body.

6. A buckle apparatus according to claim 1, wherein said regulating means has a shaft through which said lock plate is pivotally supported on said buckle body.

7. A buckle apparatus according to claim 1, further comprising a lock piece which abuts against said lock plate so as to prevent said lock plate from pivoting in the direction in which it would disengage from said tongue plate under the force of said tongue plate being pulled out.

8. A buckle apparatus according to claim 7, further comprising release means for disengaging said lock piece from said lock plate.

9. A buckle apparatus according to claim 4, wherein said lock plate is pivotally supported on said buckle body at a portion on the side thereof which is remote from said retaining wings through said tongue plate, whereby when said tongue plate is subjected to the force of being pulled out, said lock plate is pivoted in the direction in which said pawl further extends into said opening of said tongue plate.

10. A buckle apparatus employed in a seatbelt system designed to protect an occupant of a vehicle in an emergency situation of the vehicle, said apparatus being used for engagement with a tongue plate connected to an occupant restraining webbing when the occupant fastens said webbing, and said apparatus comprising:

(a) a buckle body mounted on the vehicle body for receiving said tongue plate;

(b) a lock plate inserted into an opening formed in said tongue plate when inserted into said buckle body in such a manner that the distal end of said lock plate projects out to the other side of said tongue plate, said lock plate being supported by said buckle body at portions on both sides of the portion which is received in said opening; and (c) a deformable lock plate holder that pivotally supports said lock plate on said buckle body and serves as a regulating means which allows at least one of said pair of support portions of said lock plate which support it on said buckle body to be separated from said buckle body when the force applied to said tongue plate such as to pull out said tongue plate from said buckle apparatus is relatively small, but which engages said support portion with said buckle body when said force is relatively large, whereby when the vehicle is in a normal state, it is possible to disengage said lock plate from said tongue plate with a relatively small force, and when the vehicle runs into an emergency situation, said lock plate is supported by said buckle body at both sides of the portion of said lock plate which abuts against the edge of said opening of said tongue plate, thus resisting any relatively large force acting on said tongue plate in such a manner that said tongue plate would be undesirably pulled out of said buckle apparatus without said support of said lock plate.

11. A buckle apparatus of a seatbelt system for a vehicle, comprising:

(a) a buckle body for receiving a tongue plate connected to a webbing;

(b) a lock plate inserted into an engagement opening formed in said tongue plate when inserted into said buckle body in such a manner that portions of said lock plate which are at both sides of its portion which is received within said engagement opening respectively face two portions of said buckle body; and (c) a lock plate holder which pivotally supports said lock plate on said buckle body and which is deformed when the force applied to said tongue plate to pull out said tongue plate from said buckle apparatus increases, so that the pair of portions of said lock plate which face the corresponding portions of said buckle body are engaged with the latter so as to be supported thereby.

12. A buckle apparatus according to claim 11, wherein said lock plate holder has a portion which is pivotally supported on said buckle body, and a portion which is extended from said portion and retains said lock plate at its distal end.

13. A buckle apparatus according to claim 11, wherein said lock plate has a pair of retaining wings which project in opposite directions from each other, said retaining wings respectively facing two portions on one side of said buckle body so as to constitute in combination one of said pair of support portions.

14. A buckle apparatus according to claim 13, wherein said lock plate has a projecting pawl which extends through said opening of said tongue plate in such a manner that the distal end of said pawl faces a portion on the other side of said buckle body, thereby constituting the other of said pair of support portions.

15. A buckle apparatus according to claim 11, wherein each of said pair of retaining wings faces the opening corresponding thereto formed in a pair of leg plates projecting upwardly from said buckle body.

16. A buckle apparatus according to claim 11, further comprising a lock piece which abuts against said lock plate so as to prevent said lock plate from pivoting in the direction in which it would disengage from said tongue plate under the force of said tongue plate being pulled out.

17. A buckle apparatus according to claim 14, wherein said lock plate is pivotally supported on said buckle body at a portion on the side thereof which is remote from said retaining wings through said tongue plate, whereby when said tongue plate is subjected to the force of being pulled out, said lock plate is pivoted in the direction in which said pawl further extends into said opening of said tongue plate.

18. A buckle apparatus according to claim 17, wherein said lock plate holder which pivotally supports said lock plate on said buckle body has a portion inserted into an opening formed in said buckle body so as to be pivoted about the portion of said holder received in said opening.

19. A buckle apparatus into which a tongue plate of a seatbelt for a vehicle is inserted so as to be engaged therewith, said apparatus comprising:

(a) a buckle body mounted on the vehicle;

(b) a pair of leg plates which project upwardly from the base portion of said buckle body;

(c) a lock plate for retaining said tongue plate when inserted into said buckle body, said lock plate having a pair of retaining wings respectively supported by said leg plates, and a pawl projecting from said lock plate integrally with said retaining wings, said pawl extending into an opening formed in said tongue plate and projecting therefrom in such a manner that the distal end of said pawl is supported by the base portion of said buckle body; and (d) a lock plate holder which retains said lock plate and is pivotally supported on said buckle body, said lock plate holder being made of a material which is more easily deformed than said lock plate, so that said lock plate holder allows said pawl to abut against the base portion of said buckle body only when said tongue plate is subjected to a relatively large pulling out force, thereby increasing the resistance of said lock plate against to the tongue plate pulling out force and facilitating the operation of disengaging said lock plate from said tongue plate when said tongue plate is to be released.

20. A buckle apparatus according to claim 19, wherein said retaining wings are inserted into relatively large openings respectively formed in said leg plates.

21. A buckle apparatus according to claim 19, wherein said lock plate is disposed in such a manner as to be pivoted by a tongue plate pulling out force in the direction in which said pawl moves further so as to engage with said tongue plate.

* * * * *